US006794971B2

(12) United States Patent
Smith

(10) Patent No.: US 6,794,971 B2
(45) Date of Patent: Sep. 21, 2004

(54) SYSTEM AND METHOD FOR REMOVING NOISE FROM AC OPERATED ELECTRO MAGNETS

(75) Inventor: Richard G. Smith, North Aurora, IL (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 0 days.

(21) Appl. No.: 10/714,294

(22) Filed: Nov. 14, 2003

(65) Prior Publication Data

US 2004/0130420 A1 Jul. 8, 2004

Related U.S. Application Data

(60) Provisional application No. 60/426,650, filed on Nov. 15, 2002.

(51) Int. Cl.[7] ..... H01F 7/12

(52) U.S. Cl. ..... 335/249; 335/247; 335/279

(58) Field of Search ..... 335/132, 243–252, 335/261, 279, 281

(56) References Cited

U.S. PATENT DOCUMENTS 4,451,809 A * 5/1984 Zukausky ..... 335/255

* cited by examiner

*Primary Examiner*—Ramon M. Barrera

(57) ABSTRACT

The present invention provides a formed interface there between a magnetic core proximate an armature of an electromagnetically actuable device. A coil of the electromagnetically actuable device is selectively energized to draw the armature to the magnetic core. The formed interface is adapted to provide three contact areas in a triangular configuration at the mating surfaces of the armature and magnetic core which causes a minimal magnetic air gap and a stable interface there when the coil is energized. The formed interface overcomes the surface deformations of the armature and magnetic core to reduce vibration and noise.

19 Claims, 5 Drawing Sheets

SYSTEM AND METHOD FOR REMOVING NOISE FROM AC OPERATED ELECTRO MAGNETS

CLAIM OF PRIORITY AND INCORPORATION BY REFERENCE

This application claims priority to, and incorporates by reference herein in its entirety, pending U.S. Provisional Patent Application Ser. No. 60/426,650, filed Nov. 15, 2002 and incorporates by reference herein in its entirety pending U.S. patent application No. 09/957,139, filed Sep. 20, 2001.

TECHNICAL FIELD OF THE INVENTION

This invention relates to electromagnetically actuable devices and, more particularly, to electromagnet armature and pole face contact surfaces.

BACKGROUND OF THE INVENTION

A conventional electromagnetically actuable device has a magnetic core proximate an armature. A coil is selectively energized to draw the armature to the magnetic core. The device may be a solenoid, a contactor, a motor starter, or the like. The armature is operatively associated with a movable device such as movable contacts or an actuator. In many instances the coil is selectively energized from an AC power source. With AC-operated electromagnets, elimination or control of noise is a prime concern. To minimize noise the surface interface of the magnetic core and armature of each device must be matched to provide minimal magnetic "air gap" and a stable interface surface. The minimal air gap assures sufficient force to prevent movement and the stable surface interface prevents movements due to the widely changing forces in the AC-operated device. In most conventionally devices, spring loads provide a steady force between the magnetic core and the armature. Energization of the coil counteracts the spring force to draw the armature toward the magnetic core. However, with an AC power source operating at, for example, 60 Hz, there are 120 zero crossings each second during energization. This in combination with other variations in contact surfaces can produce a noisy device.

A conventional approach to minimizing noise has been to grind all interfacing magnetic surfaces. This is a costly operation which must be done within tight limits and can have poor results. Small warping of either magnetic part can still result in an unstable and thus noisy electromagnet.

SUMMARY OF THE INVENTION

In accordance with the invention, an electromagnetically actuable device includes a formed interface to minimize noise.

Broadly, there is disclosed herein an electromagnetically actuable device having a magnetic core proximate an armature and a coil selectively energized to draw the armature to the magnetic core. The device comprises the armature, magnetic core and a formed interface there between that is adapted to provide three contact areas in a triangular configuration to provide minimal magnetic air gap and a stable interface when the coil is energized.

In one aspect of the invention the shape of the formed interface is concave.

In another aspect of the invention the shape of the formed interface is convex.

In all aspects of the invention the shape of the formed interface positioned between the armature and magnetic core provides a three point interface to minimize the magnetic air gap cause by surface deformations of the armature and magnetic core. The result is reduced vibration and noise.

It is a feature of the invention that the formed interface is formed of steel. The steel can be laminated magnetic steel. The formed interface is shaped with an arc or other shape to provide three contact areas between the magnetic core and the armature.

In accordance with one embodiment of the invention, the three contact areas can be rounded.

In accordance with another embodiment of the invention the three contact areas can be generally pointed. It will be appreciated that the three contact areas may be of an alternative shape.

It is a feature of an embodiment of the invention that a surface offset of an end portion of a formed interface is 0.002 inches or less. The surface offset promoting a minimal magnetic air gap and stable interface when the coil is energized.

It is still another feature of an embodiment of the invention that a surface offset of the end portion of the formed interface is greater than 0.002 inches. The surface offset promoting a minimal magnetic air gap and stable interface when the coil is energized.

There is disclosed in accordance with a further aspect of the invention an electromagnetically actuable device including a base. A magnetic core is fixedly mounted to the base. An armature is movably mounted to the base proximate the magnetic core. A coil is fixedly mounted to the base and is selectively energized to draw the armature to the magnetic core. A formed interface positioned between the armature and magnetic core includes mating surfaces adapted to provide three contact areas in a triangular configuration to provide minimal magnetic air gap and a stable interface when the coil is energized.

Further features and advantages of the invention will be readily apparent from the specification and from the drawings.

DETAILED DESCRIPTION OF THE INVENTION

Figure 1:
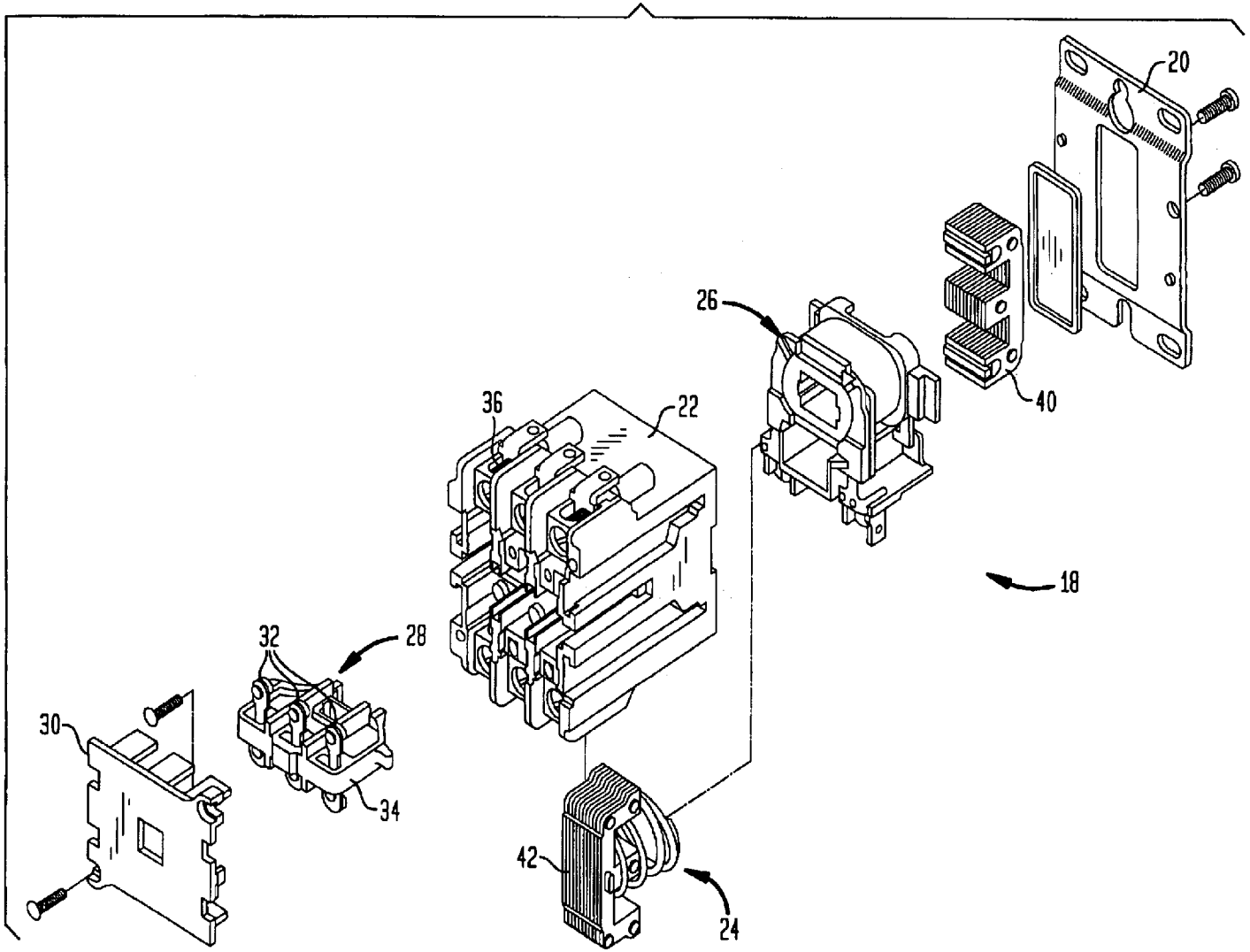
FIG. 1 is an exploded, perspective view of an electromagnetically actuable device in the form of a contactor including an electromagnet in accordance with the invention.

Referring initially to FIG. 1, an electromagnetically actuable device in the form of an electrical contactor 18 is illustrated in exploded form. The contactor 18 includes a base 20, a housing 22, an electromagnet 24, a coil 26 an actuator assembly 28 and a cover plate 30. The electromagnet 24 includes a magnetic core 40 and an armature 42. The housing 22 is mounted to the base and encloses the coil 26 and the magnetic core 40. The magnetic core 40 is fixedly mounted in the housing 22. The magnetic core 40 is made of laminated magnetic steel, as is well known. The coil 26 includes a conventional bobbin, winding and terminal assembly and is located within the housing 22 and on the magnetic core 40. The armature 42 is also of laminated magnetic steel and is associated with movable contacts 32 carried on a contact carrier 34 moveably mounted in the housing 22. The housing 22 also supports stationary contacts 36 positioned in proximity with the moveable contacts 32.

When the coil 26 is energized, the movable armature 42 is drawn toward the magnetic core 40 in a conventional manner. The movement of the armature 42 toward the magnetic core 40 causes the moveable contacts 32 to selectively open or close an electrical circuit with the stationary contacts 36.

While this application illustrates an electromagnetically actuable device in the form of a contactor, the teachings of the invention can similarly be applied to other electromagnetically actuable devices such as AC solenoids, electromagnetic actuators, motor starters, or the like.

In accordance with the invention, a formed interface provided between the armature 42 and magnetic core 40 is shaped to provide mating surfaces between the armature 42 and magnetic core 40 that are adapted to provide three contact areas in a triangular configuration between the armature and magnetic core, as described below, to provide minimal magnetic air gap and a stable interface when the coil 26 is energized.

Figure 2A:
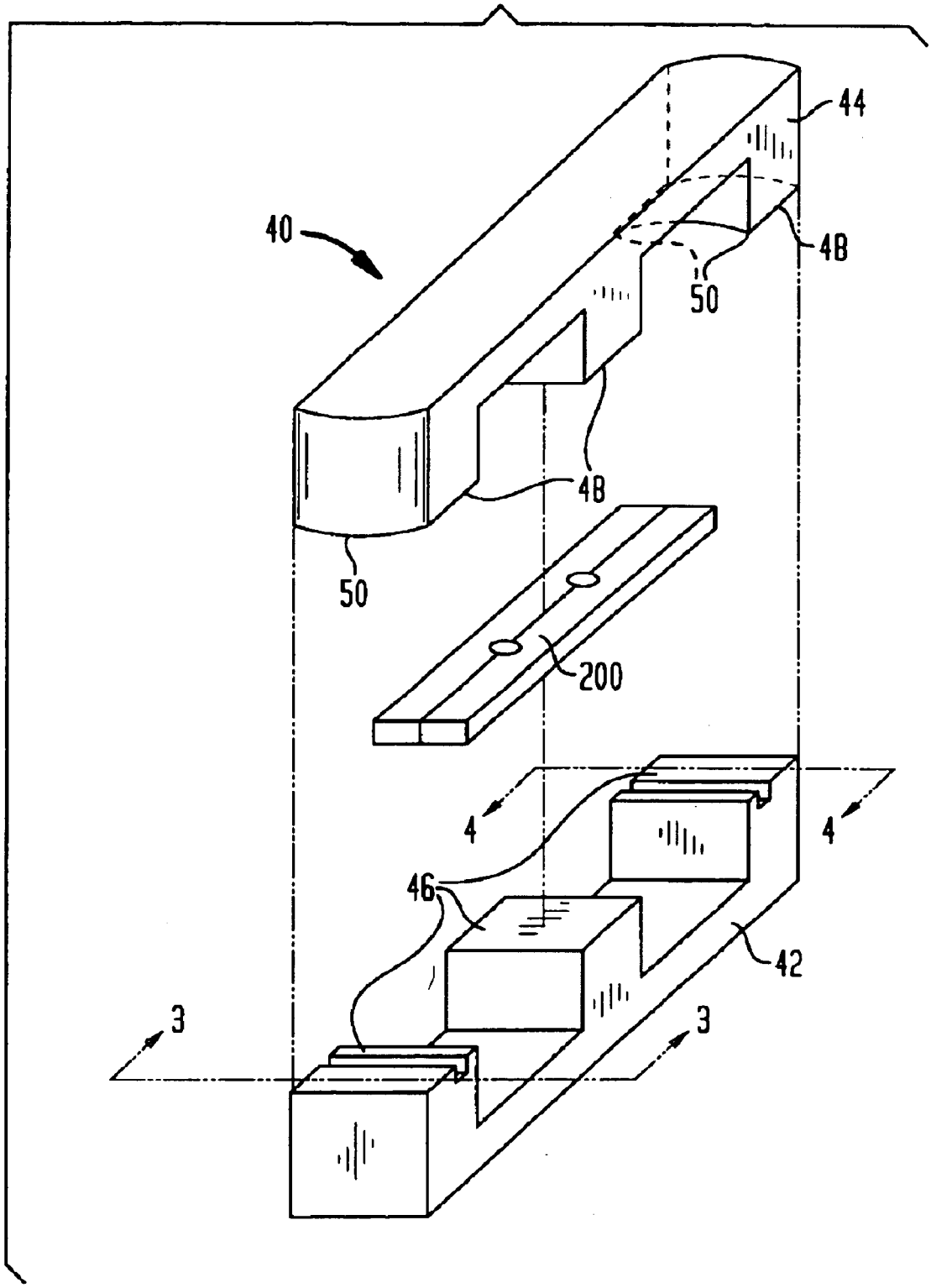
FIG. 2A is an exploded view of an embodiment in accordance with the invention.

Referring to FIG. 2A, electromagnet 40 is illustrated. The magnetic core 42 and the armature 44 are E-shaped. Similarly, the magnetic core 42 and armature 44 can be formed of laminated magnetic steel construction. The magnetic core 42 includes mating surfaces 46 and the armature 44 includes mating surfaces 48. A formed interface 200 is provided there between which is adapted to provide three contact areas 50 in a triangular configuraton between the armature 44 and the mating surface 48. As such, when the coil 26 is energized, the armature 44 is drawn to the magnetic core 42 and contact occurs at only the three contact areas 50. The triangular configuration of the three contact areas 50 provides a tripod-like mating that prevents rocking of the armature 44 relative to the magnetic core 42.

Figure 2B:
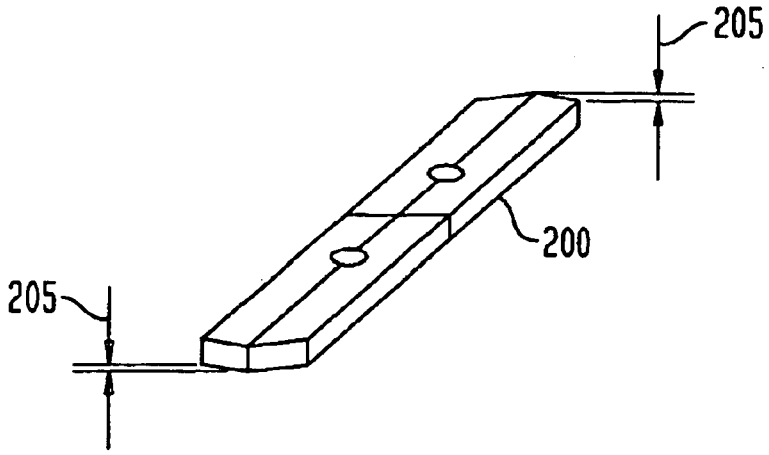
FIGS. 2B, 2C, 2D and 2E are a respective emphasized, perspective, top and profile view of an embodiment of a formed interface in accordance with the invention.
Figure 2C:
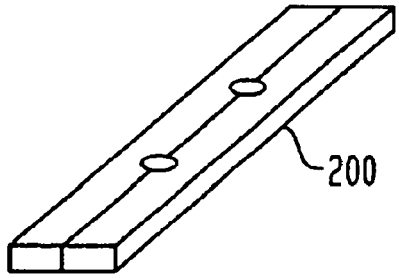

Referring to FIGS. 2B and 2C, respective emphasized and perspective views of an embodiment of a formed interface 200 are shown. It will be appreciated that as shown, each end of formed interface 200 is slightly angled from the center line of the formed interface 200 to each side edge. As shown in the embodiment of FIG. 2, an end portion 205 of formed interface 200 is angled so that there is an offset of end portion 205 of formed interface 200. In an embodiment the surface offset is a value of 0.002 inches or less. However, it will be appreciated that alternative embodiments of the present invention may include a surface offset greater than 0.002 inches, if the surface offset does not result in an air gap which negates the benefits of formed interface 200, such as stability and reduced noise.

Figure 2D:
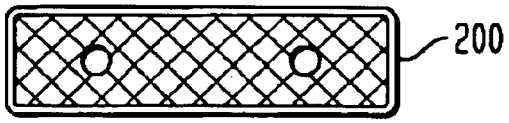
Figure 2E:
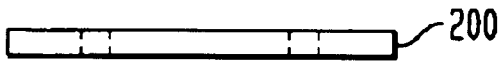
Figure 2F:
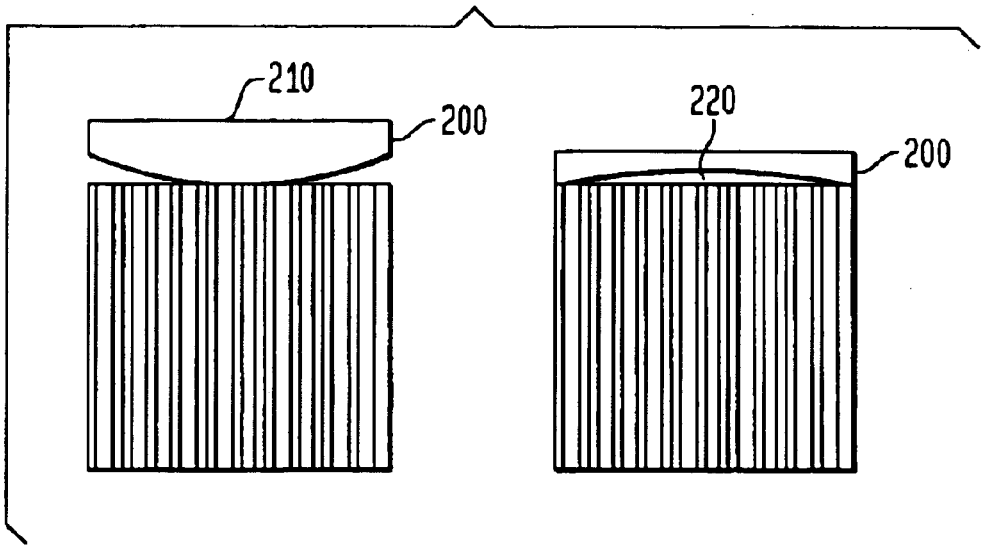
FIG. 2F is an embodiment of respective concave and convex shaped examples of a formed interface in accordance with the invention.
Figure 2G:
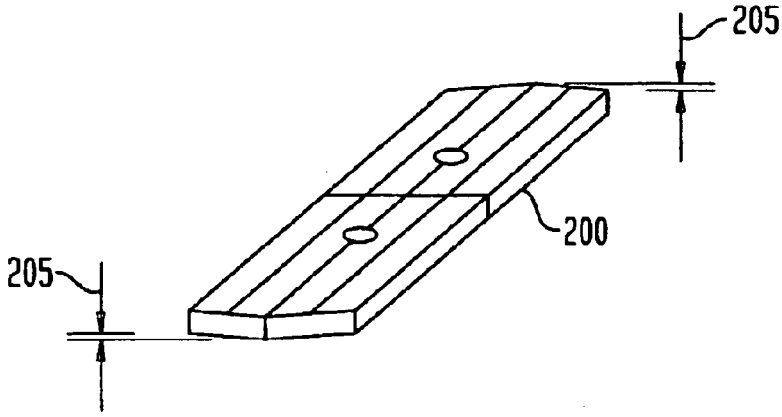
FIGS. 2G and 2H is an embodiment of a formed interface in accordance with the invention.
Figure 2H:
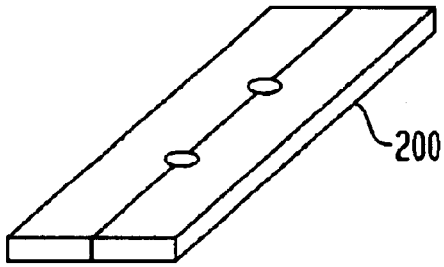

For example, it will appreciated that in an alternative embodiment, as shown in FIGS. 2G and 2H, the surface offset of end portion 205 of formed interface 200 is approximately 0.004 to 0.002 inches. Alternatively, the offset of the end portion can be a value of at least 0.01 inches.

Referring to FIGS. 2D and 2E, respective top and profile views of detailed specifications of an embodiment of formed interface 200 are shown. Formed interface 200 is stamped, coined or otherwise formed, such that a three point interface between armature 44 relative to the magnetic core 42 is assured. It will be appreciated that for certain embodiments, formed interface 200 can comprise three line segments or small areas in a triangular pattern.

Referring to FIG. 2F, an embodiment of a mating surface 210 of formed interface 200 having a convex shape, and an embodiment of a mating surface 220 of formed interface 200 having a concave shape are shown. The result is a formed interface 200 including a contact area in the center of the adjoining pole face and two contact areas at the outer edges of the other pole face.

Figure 3:
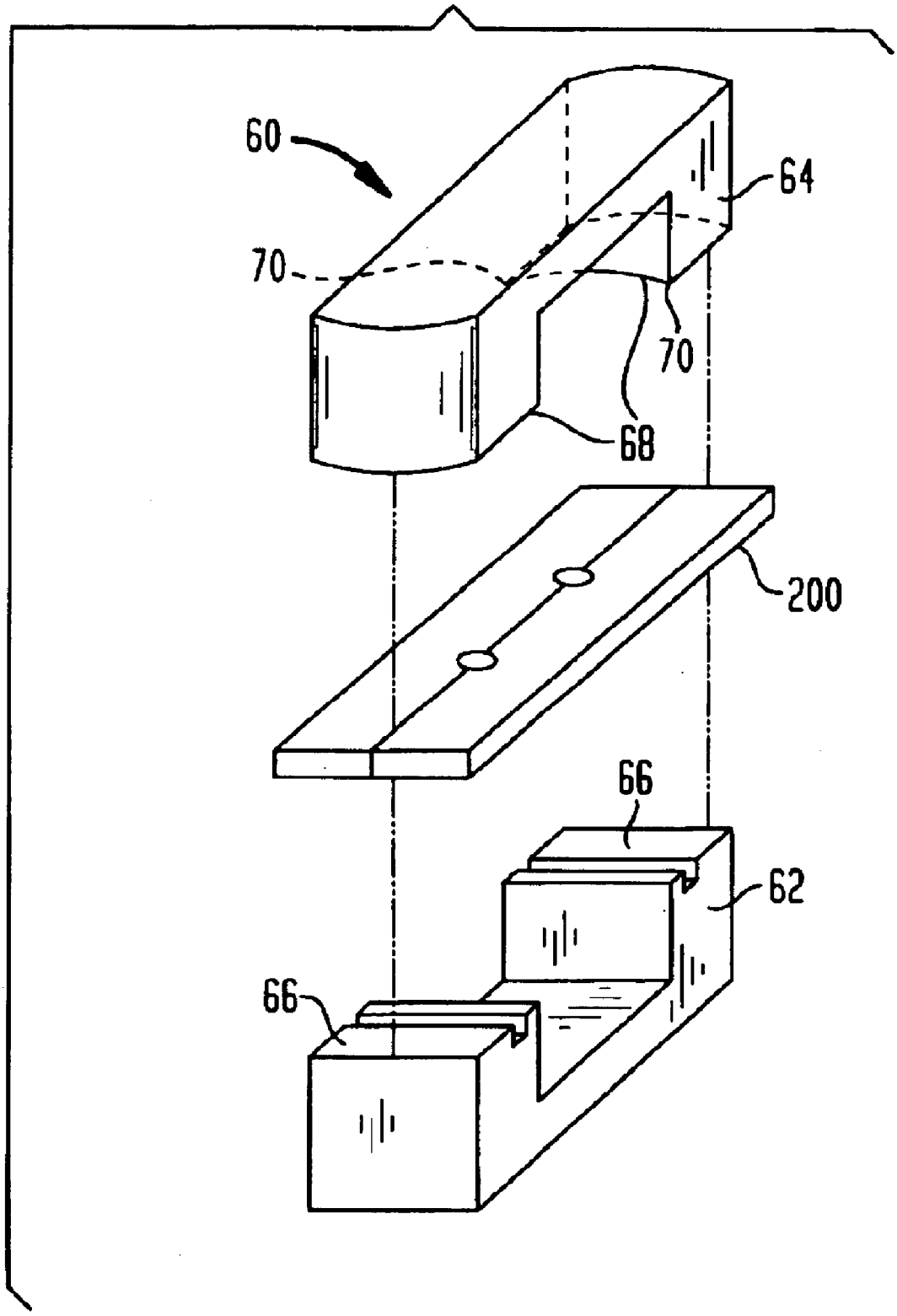
FIG. 3 is an exploded view of an embodiment in accordance with the invention.

Referring to FIG. 3, an electromagnet 60 having a "C"-shaped magnetic core 62 and armature 64 are illustrated. The magnetic core 62 has mating surfaces 66 while armature 64 has mating surfaces 68. A formed interface 300 is provided between the mating surfaces 66 of the magnetic core 62 and the mating surfaces 68 of armature 64.

The shape of the formed interface 300 may be generally rounded. For example, the formed interface 300 may be defined by a concave arc at one end and a convex arc at the opposite end. Alternatively, a shape of formed interface 300 may be generally pointed.

It will be appreciated that alternative shapes of formed interface 200 would include modifications of arcs and triangles to generally form the contact areas to assure central contact at one pole surface interface and contact at the other pole interface to be a wide interface area or two areas spaced widely apart.

Thus, in accordance with the invention, an electromagnet utilizes a formed interface positioned between an armature 64 and magnetic core 62 having mating surfaces adapted to provide three contact areas in a triangular configuration to provide minimal magnetic air gap and a stable interface when a coil is energized.

It can therefore be appreciated that a new and novel system and method for an electromagnetic formed interface has been described. It will be appreciated by those skilled in the art that, given the teaching herein, numerous alternatives and equivalent will be seen to exist which incorporate the disclosed invention. As a result, the invention is not to be limited by the foregoing exemplary embodiments, but only by the following claims.

I claim:

1. An electromagnetically actuable device comprising:

a magnetic core;

an armature proximate the magnetic core;

a coil selectively energized to draw the armature to the magnetic core; and a formed interface positioned between the armature and magnetic core having a shape adapted to provide three contact areas in a triangular configuration between mating surfaces of the armature and the magnetic core.

2. The device of claim 1, wherein the formed interface provides minimal magnetic airgap between the armature and the magnetic core to promote a stable interface when the coil is energized.

3. The device of claim 1, wherein the formed interface minimizes noise.

4. The device of claim 1, wherein the formed interface is of a concave shape.

5. The device of claim 1, wherein the formed interface is of a convex shape.

6. The device of claim 1, wherein the electromagnetically actuable device is a contactor.

7. The device of claim 1, wherein the electromagnetically actuable device is an AC solenoid.

8. The device of claim 1, wherein the electromagnetically actuable device is an electromagnetic actuator.

9. The device of claim 1, wherein the electromagnetically actuable device is a motor starter.

10. The device of claim 1, wherein the formed interface includes an end portion having an angled edge from its center line to a side edge.

11. The device of claim 10, wherein the angled edge of the end portion is offset to minimize an air gap between the armature and the magnetic core to minimize noise there between.

12. The device of claim 11, wherein the angled edge of the end portion has an offset of at least 0.002 inches.

13. The device of claim 11, wherein the angled edge of the end portion has an offset between and including 0.004 to 0.002 inches.

14. The device of claim 11, wherein the angled edge of the end portion has an offset between and including 0.01 to 0.004 inches.

15. The device of claim 1, wherein the formed interface is stamped, coined or otherwise formed.

16. The device of claim 1, wherein the formed interface includes a contact area in the center of an adjoining pole face and two contact areas at outer edges of another pole face there between the magnetic core and the armature.

17. The device of claim 1, wherein the formed interface possess a convex shape at one end and a concave shape at the other end.

18. A method for stabilizing actuation of an electromagnetic device comprising:

positioning a formed interface between an armature and a magnetic core, wherein the formed interface has a shape adapted to provide three contact areas in a triangular configuration there between.

19. The method of claim 18, wherein the triangular configuration is provided by the formed interface having a concave shape at one end and a convex shape at the other, the concave and convex shapes resulting in a contact area in the center of an adjoining pole face and two contact areas at outer edges of another pole face therebetween the magnetic core and the armature.

* * * * *